US008998647B2

(12) United States Patent
Tsai et al.

(10) Patent No.: US 8,998,647 B2
(45) Date of Patent: Apr. 7, 2015

(54) ELECTRICAL CONNECTOR

(71) Applicant: Power Quotient International Co., Ltd., New Taipei (TW)

(72) Inventors: Chia Hsin Tsai, New Taipei (TW); Charles C. Lee, New Taipei (TW); Yu Cheng Chang, New Taipei (TW); Jen Fu Chen, New Taipei (TW)

(73) Assignee: Power Quotient International Co., Ltd., New Taipei (TW)

( * ) Notice: Subject to any disclaimer, the term of this patent is extended or adjusted under 35 U.S.C. 154(b) by 20 days.

(21) Appl. No.: 13/902,112

(22) Filed: May 24, 2013

(65) Prior Publication Data

US 2013/0344730 A1 Dec. 26, 2013

(30) Foreign Application Priority Data

Jun. 4, 2012 (TW) ..... 101210723 U

(51) Int. Cl.

| | |
|---|---|
| ***H01R 12/00*** | (2006.01) |
| ***H01R 13/717*** | (2006.01) |
| ***H01R 24/62*** | (2011.01) |
| *H01R 13/66* | (2006.01) |

(52) U.S. Cl.

CPC ..... *H01R 13/717* (2013.01); *H01R 24/62* (2013.01); *H01R 13/6658* (2013.01)

(58) Field of Classification Search

CPC ... H01R 13/717; H01R 13/6658; H01R 24/62
USPC ..... 439/76.1, 607.35–607.4, 660
See application file for complete search history.

(56) References Cited

U.S. PATENT DOCUMENTS

| | | | | |
|---|---|---|---|---|
| 7,329,153 | B2 * | 2/2008 | Lin et al. | 439/660 |
| 7,878,862 | B2 * | 2/2011 | Shi et al. | 439/660 |
| 7,909,654 | B2 * | 3/2011 | He et al. | 439/660 |
| 8,262,416 | B2 * | 9/2012 | Nguyen et al. | 439/660 |
| 8,439,708 | B2 * | 5/2013 | Colantuono et al. | 439/660 |

* cited by examiner

*Primary Examiner* — Khiem Nguyen
(74) *Attorney, Agent, or Firm* — WPAT, P.C.; Anthony King

(57) ABSTRACT

An electrical connector includes a fastening part, a connector body assembled under the fastening part and defining at least one receiving groove at a mating end thereof, a base board positioned under the connector body, and a shielding shell. The connector body and the base board can be firmly fastened in the shielding shell by means of the fastening part. At least one end edge of the shielding shell is bent inward to form a positioning tail positioned in the receiving groove to position the mating end of the connector body with a front face of the mating end being flush with the end edge of the shielding shell and a contact face of the connector body being substantially flush with a top edge of the positioning tail, so as to avoid the mating end of the connector body wrapping in use.

11 Claims, 6 Drawing Sheets

ELECTRICAL CONNECTOR

BACKGROUND OF THE INVENTION

1. Field of the Invention

The present invention relates to an electrical connector, and more particularly to an electrical connector compatible with the USB (Universal Serial Bus) 2.0 specification and the USB 3.0 specification.

2. The Related Art

Nowadays, with the development of electronic technology, electronic products and peripheral devices thereof are connected with each other more and more frequently. And it is a kind of common connection way to realize an electrical connection between the electronic product and its peripheral device by virtue of an electrical connector. Furthermore, the rapid developments of the electronic technology call for more stringent requirements to signal transmission rate of the electrical connector. So an electrical connector defined by the USB 3.0 specification emerges as the times require. But because USB 2.0 connectors are still the mainstream specification at present, an electrical connector compatible with the USB 2.0 specification and the USB 3.0 specification comes with the tide of fashion.

The conventional electrical connector compatible with the USB 2.0 specification and the USB 3.0 specification generally includes a connector body, a plurality of first terminals and second terminals disposed in the connector body and each having a soldering tail, a base board and a shielding shell enclosing the connector body and the base board. The soldering tails project behind the connector body in a transverse row and are soldered with the base board. In use, the electrical connector is inserted in a mating connector to realize electrical connection with the mating connector. However, because only a rear end of the connector body has adhesion with the base board by means of the soldering of the soldering tails and the base board and a mating end of the connector body is free with respect to the base board and the shielding shell, the mating end of the connector body is apt to be warped by the mating connector in use. As a result, a poor electrical connection often happens between the electrical connector and the mating connector.

SUMMARY OF THE INVENTION

It is an object of the present invention to provide an electrical connector. The electrical connector includes a fastening part, a connector body, a base board and a shielding shell enclosing the fastening part, the connector body and the base board therein. The fastening part defines at least one fixing groove at a top thereof, and at least one buckling block is protruded at a bottom of the fastening part. The connector body is assembled under the fastening part and equipped with a plurality of first terminals and second terminals of which each has a contact portion and a soldering tail. The contact portions are exposed in front of the fastening part and the soldering tails project behind the connector body. A front end of the connector body defines a guiding slope and at least one receiving groove adjacent to a distal end of the guiding slope. At least one side of a rear of the connector body defines a buckling groove buckling with the buckling block of the fastening part. The base board is positioned under the connector body and has a plurality of first contact pads and a plurality of second contact pads which are embedded and exposed on the base board and electrically soldered with the soldering tails of the first terminals and the second terminals. The shielding shell defines at least one fixing portion buckled with the fixing groove of the fastening part. At least one end edge of the shielding shell corresponding to the receiving groove of the connector body is bent inward to form a positioning tail positioned in the receiving groove to make a front face of the connector body flush with the end edge of the shielding shell, and make a top face of the connector body substantially flush with a top edge of the positioning tail.

As described above, the electrical connector in this invention can be compatible with the USB 2.0 specification and the USB 3.0 specification, and meet the requirement of different signal transmission rates. Besides, the connector body can be firmly positioned on the base board to avoid warping because two ends thereof have adhesion with the base board. Moreover, the connector body and the base board can be firmly fastened in the shielding shell by means of the fastening part. Furthermore, the positioning tail is positioned in the receiving groove so that can effectively ensue the front face of the connector body flush with the end edge of the shielding shell, and the contact face of the connector body substantially flush with the top edge of the positioning tail so as to further avoid the mating end of the connector body wrapping in use. So a good electrical connection can be achieved between the electrical connector and a mating connector.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
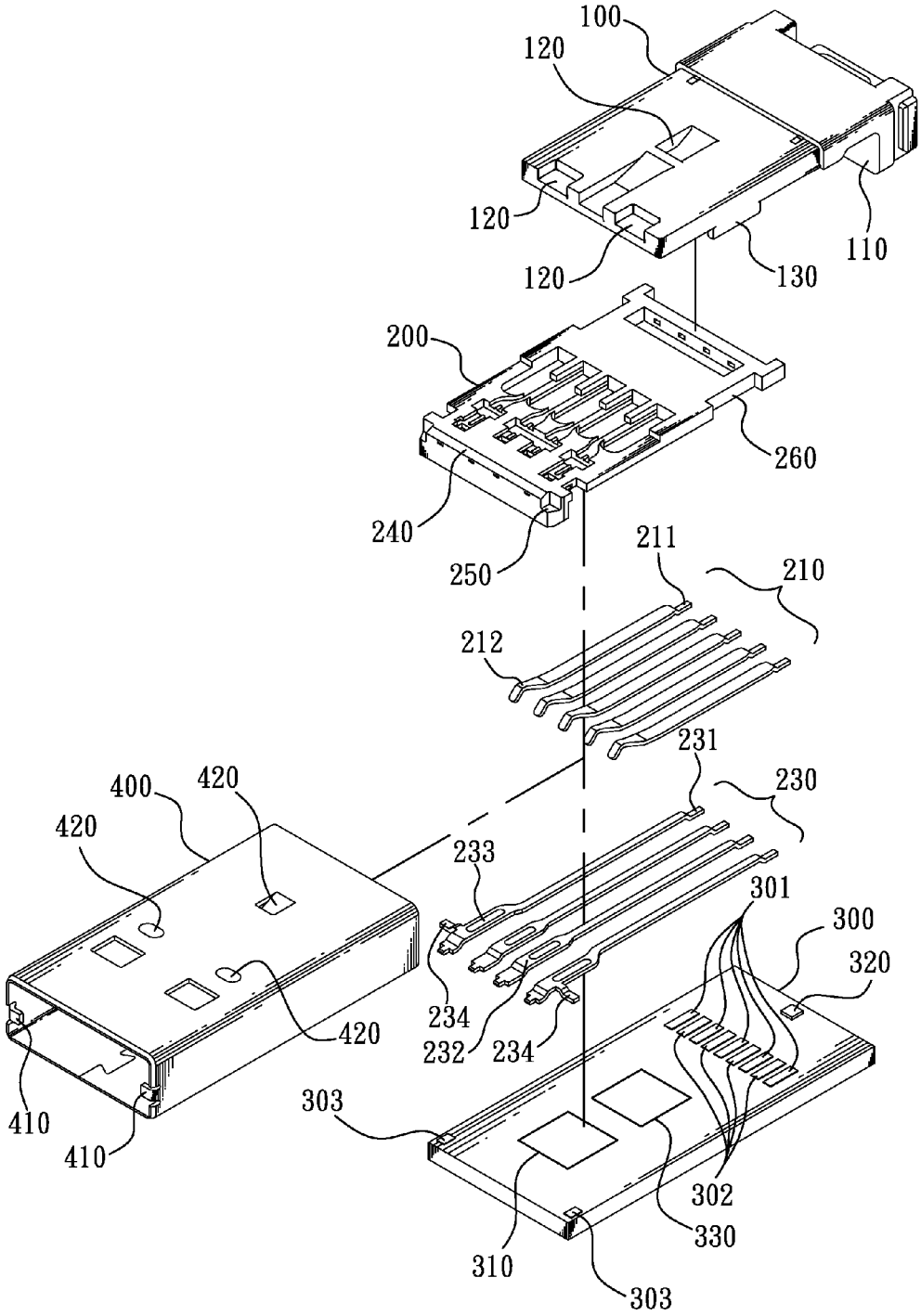
FIG. 1 is an exploded perspective view of an electrical connector in accordance with an embodiment of the present invention.
Figure 2A:
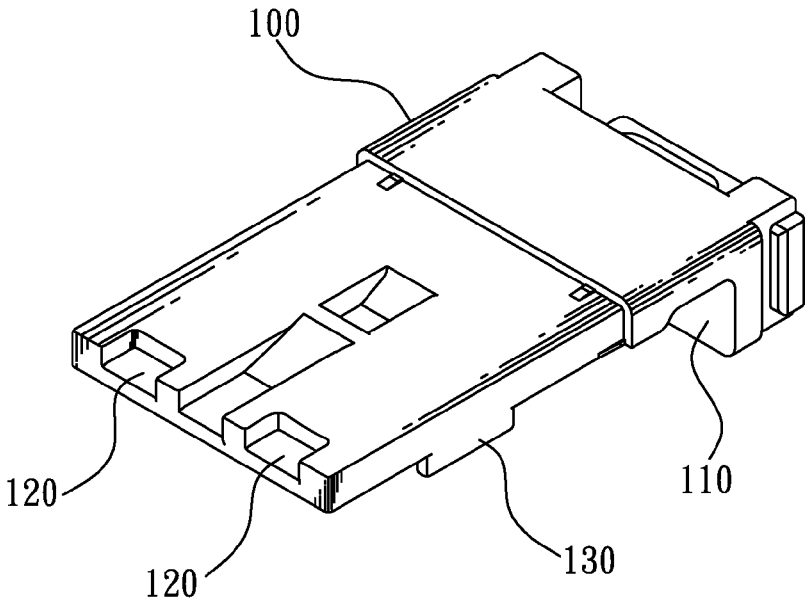
FIG. 2*a* is a perspective view of a fastening part according to an embodiment of the present invention.
Figure 2B:
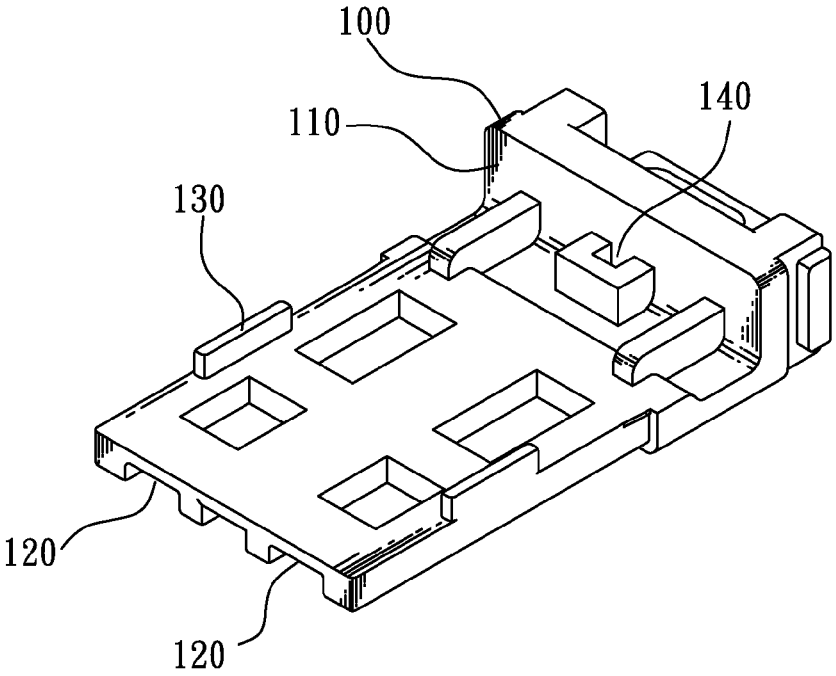
FIG. 2*b* is a perspective view of the fastening part of FIG. 2*a* seen from another angle.
Figure 3A:
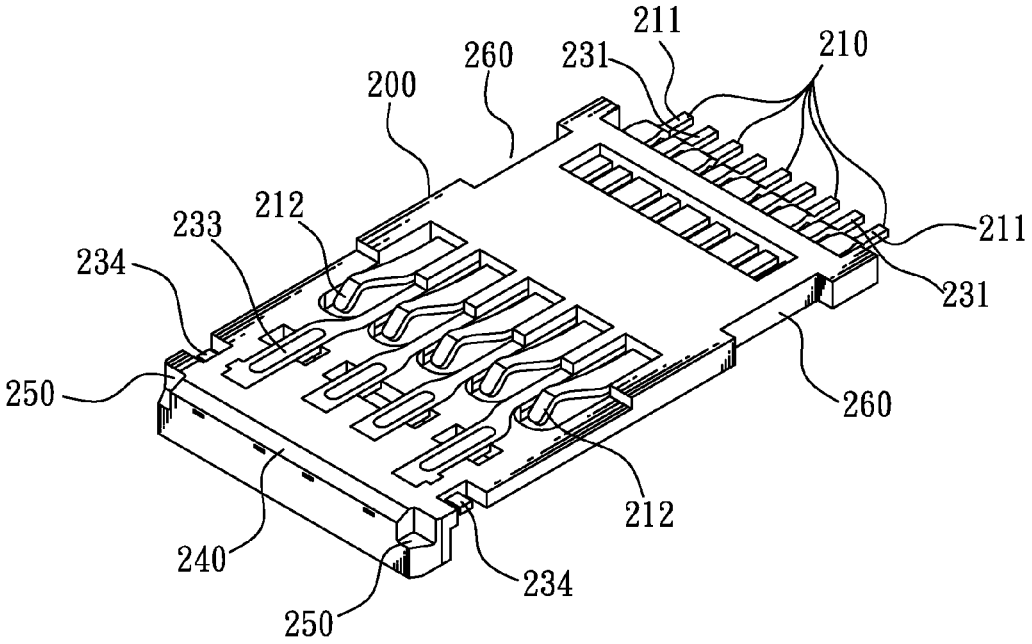
FIG. 3*a* is a perspective view of a connector body with a plurality of terminals according to an embodiment of the present invention.
Figure 3B:
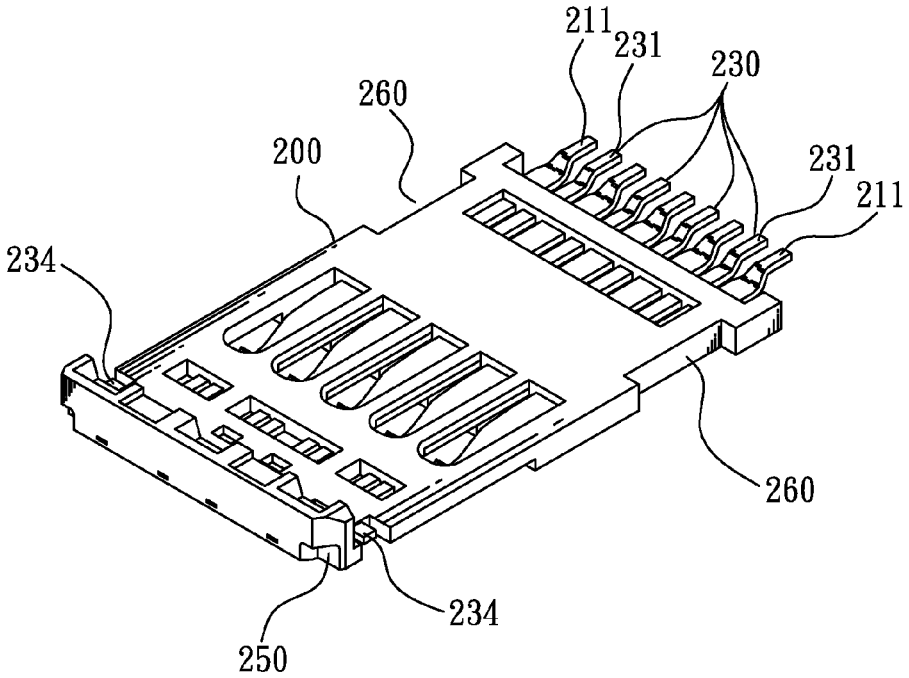
FIG. 3*b* is a perspective view of the connector body with the terminals of FIG. 3*a* seen from another angle.
Figure 4:
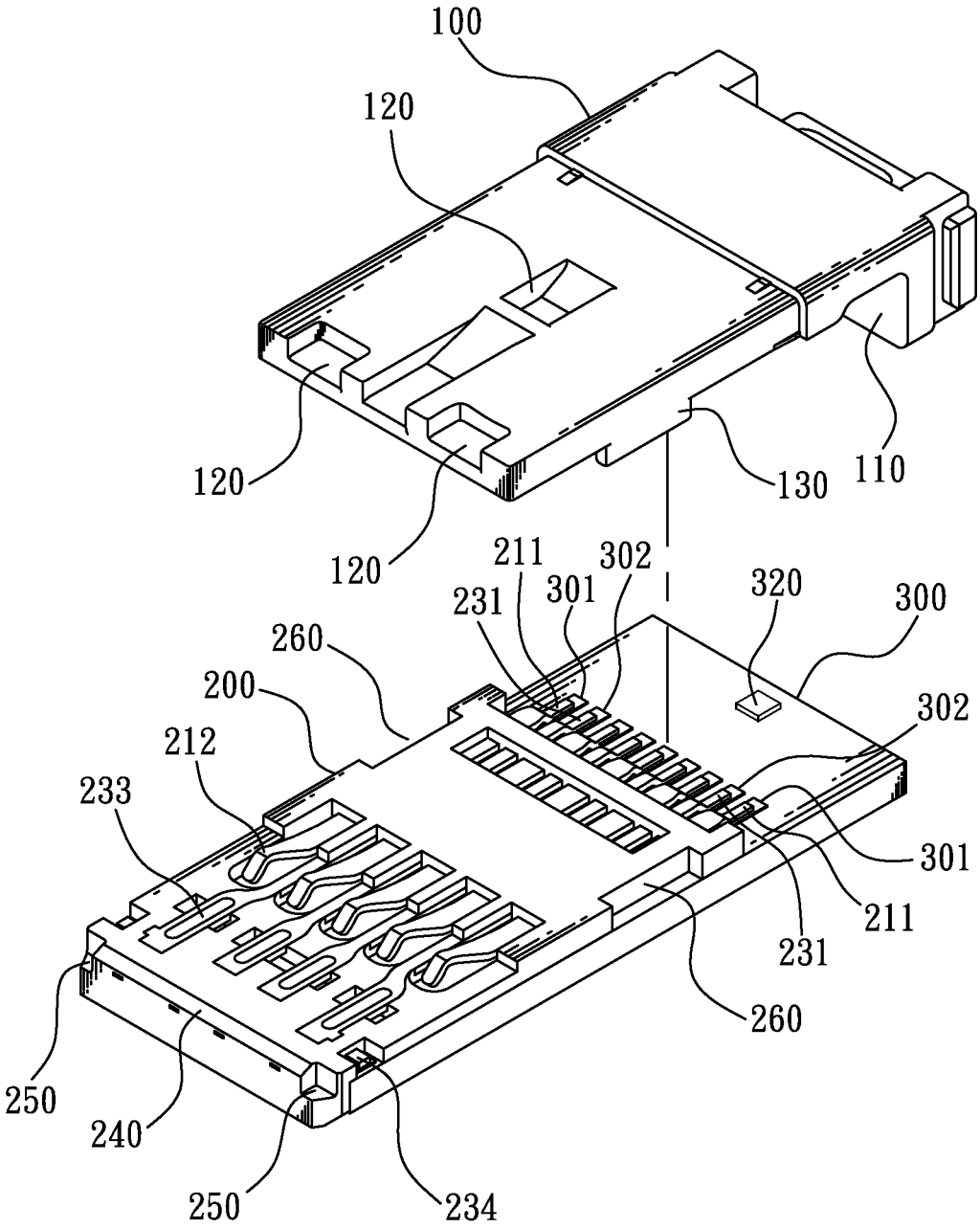
FIG. 4 is a perspective view showing that the connector body of FIG. 3*a* and FIG. 3*b* is assembled on a base board of an embodiment of the present invention.
Figure 5:
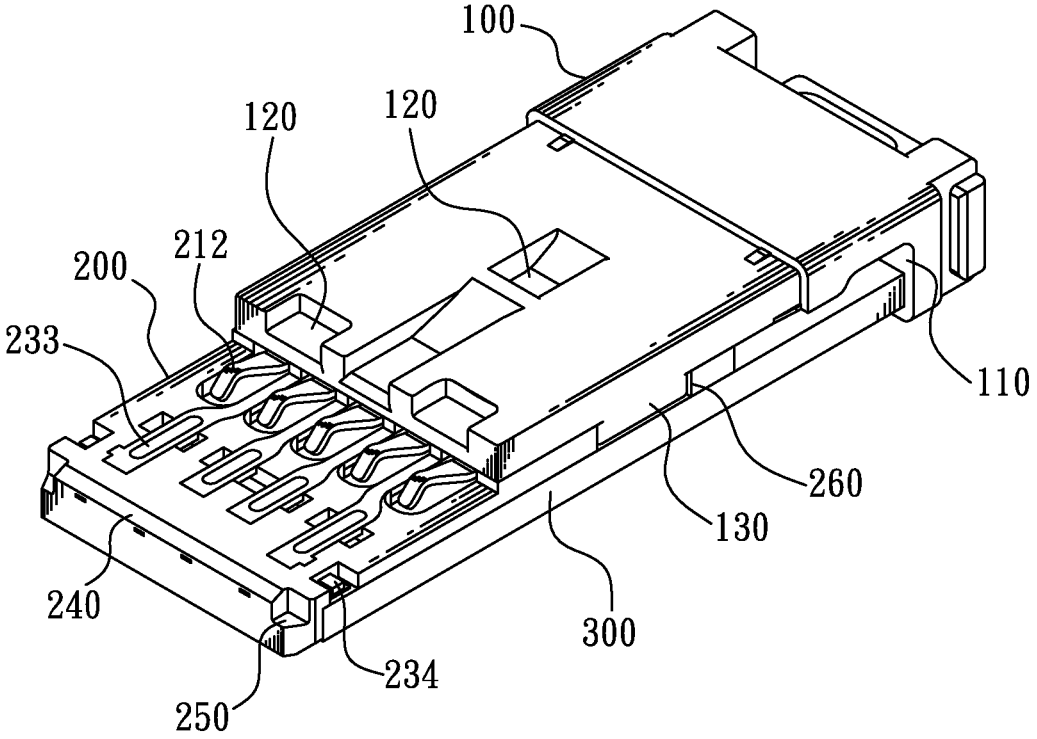
FIG. 5 is a perspective view showing that the connector body of FIG. 3*a* and FIG. 3*b*, the base board of FIG. 4, and the fastening part of FIG. 2*a* and FIG. 2*b* are assembled together.
Figure 6:
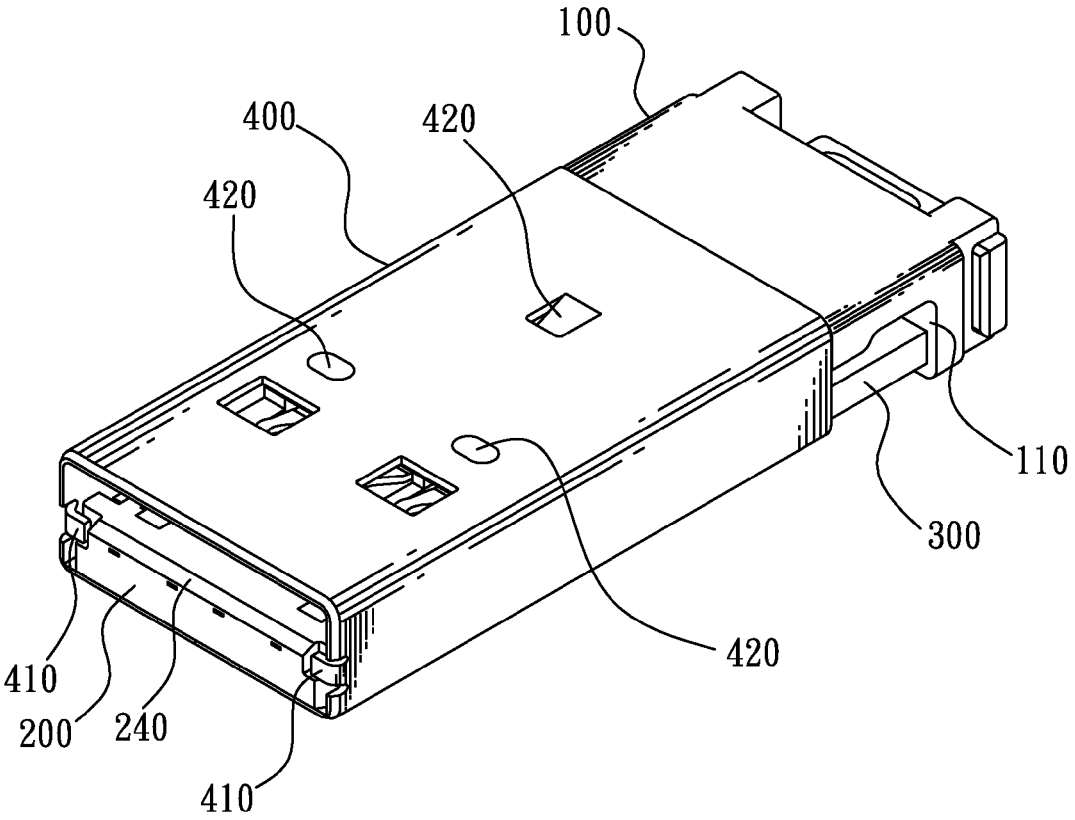
FIG. 6 is an assembled perspective view of the electrical connector of FIG. 1.

Referring to FIGS. 1-6, an electrical connector according to an embodiment of the present invention includes a fastening part 100, a connector body 200, a base board 300 and a shielding shell 400.

The fastening part 100 is made of plastic materials and pervious to light. One end of the fastening part 100 extends downward to form a blocking wall 110, and the other end of the fastening part 100 defines at least one fixing groove 120 at a top thereof. At least one buckling block 130 is protruded at a bottom of the fastening part 100 and apart located in front of the blocking wall 110. In this embodiment, two sides of the bottom of the fastening part 100 protrude downward to respectively form the buckling block 130. The fastening part 100 further defines a receiving hole 140 preferredly opened adjacent to an inner side of the blocking wall 110.

The connector body 200 is assembled under the fastening part 100 and equipped with a plurality of first terminals 210 and a plurality of second terminals 230. A front end of the connector body 200, namely a mating end, defines a guiding slope 240 for guiding a mating connector (not shown) to match with the connector body 200. At least one side of the front end of the connector body 200 further defines a receiving groove 250 adjacent to a distal end of the guiding slope 240. At least one side of a rear of the connector body 200 defines a buckling groove 260 corresponding to the buckling block 130 of the fastening part 100 for buckling with the buckling block 130 so as to fasten the fastening part 100 and the connector body 200 together. In this embodiment, there are two buckling grooves 260 oppositely opened in two side edges of the rear of the connector body 200.

The first terminals 210 each has a soldering tail 211 at one end thereof and a contact portion 212 at the other end thereof. The second terminals 230 are arranged alternately with the first terminals 210, and each has a soldering tail 231 at one end thereof and a contact portion 232 at the other end thereof. In this embodiment, the first terminals 210 have such as but not limited to five and the second terminals 230 have such as but not limited to four. The contact portion 232 of the second terminal 230 further defines a contact protrusion 233 thereon for enhancing an electrical contact thereof. Moreover, two outside edges of outmost two of the second terminals 230 oppositely protrude sideward to form a pair of soldering feet 234 at the other ends of the outmost two second terminals 230 near to the contact portions 232.

The base board 300 is positioned under the connector body 200, and is a COB (Chip on Board), a PCB (Printed Circuit Board) or the others. Because the COB has the advantages of thin in depth, compact circuit and small size, it is popular with the package of LCD (Liquid Crystal Display) driver chip or NAND flash. In this embodiment, it takes the COB for example to describe the base board 300.

The base board 300 has a plurality of first contact pads 301 and a plurality of second contact pads 302 embedded and exposed on the base board 300. The first contact pads 301 and the second contact pads 302 are apart arranged in a way of such as but not limited to alternating with one another for electrically soldering with the soldering tails 211, 231 of the first terminals 210 and the second terminals 230 respectively. The first contact pads 301 have such as but not limited to five for transmitting the signals in USB 3.0 specification of StdA_SSRX−, StdA_SSRX+, GND_DRAIN, StdA_SSTX− and StdA_SSTX+ respectively. The second contact pads 302 have such as but not limited to four for transmitting the signals in USB 2.0 specification of $V_{BUS}$, D−, D+ and GND respectively. So the electrical connector in this invention can be compatible with the USB 2.0 specification and the USB 3.0 specification, and meet the requirement of different signal transmission rates.

The base board 300 further defines two soldering pads 303 thereon corresponding to the soldering feet 234 of the second terminals 230 for soldering with the soldering feet 234 respectively. Therefore, one end of the connector body 200 is positioned on the base board 300 by means of the soldering tails 211, 231 of the first terminals 210 and the second terminals 230 being soldered with the first contact pads 301 and the second contact pads 302, and the other end of the connector body 200 is positioned on the base board 300 by means of the soldering feet 234 of the second terminals 230 being soldered with the soldering pads 303, so that the connector body 200 can be firmly positioned on the base board 300 on account of two ends thereof having adhesion with the base board 300 so as to avoid warping.

The base board 300 is further equipped with a USB controller 310, an indicator light 320 and at least one flash memory 330. The USB connector 310 and the flash memory 330 are coupled with the first contact pads 301 and the second contact pads 302. The indicator light 320 is coupled with the USB controller 310 for indicating working states of the base board 300. In this embodiment, the USB controller 310 and the flash memory 330 are packaged on the base board 300 by means of the COB technology, and the indicator light 320 is a light-emitting diode and preferredly located at a position of the base board 300 corresponding to the receiving hole 140 of the fastening part 100 to be located in the receiving hole 140.

The shielding shell 400 is hollow to enclose the fastening part 100, the connector body 200 and the base board 300 therein. At least one end edge of the shielding shell 400 corresponding to the receiving groove 250 of the connector body 200 is bent inward to form a positioning tail 410 positioned in the receiving groove 250 so as to make a front face (namely a mating face) of the connector body 200 flush with the end edge of the shielding shell 400, and make a contact face (namely a top face in this embodiment) of the connector body 200 substantially flush with a top edge of the positioning tail 410, so that further avoids the mating end of the connector body 200 wrapping in use. The shielding shell 400 further defines at least one fixing portion 420 corresponding to the fixing groove 120 of the fastening part 100 for being buckled with the fixing groove 120 so as to fasten the fastening part 100 in the shielding shell 400. In this embodiment, there are three fixing grooves 120 and three fixing portions 420 respectively.

Referring to FIGS. 4-6 again, in manufacturing, the first terminals 210 and the second terminals 230 are molded in the connector body 200 by injection molding after they are arranged alternately with one another, wherein the soldering tails 211, 231 project behind the connector body 200 in a transverse row. Then the connector body 200 is positioned on the base board 300 with the soldering tails 211, 231 of the first terminals 210 and the second terminals 230 being soldered with the first contact pads 301 and the second contact pads 302 and the soldering feet 234 of the second terminals 230 being soldered with the soldering pads 303 by the surface mount technology. Next, the fastening part 100 is assembled on the connector body 200 with the contact portions 212, 232 of the first terminals 210 and the second terminals 230 being exposed in front of the fastening part 100. The blocking wall 110 abuts behind the base board 300 with the indicator light 320 being located in the receiving hole 140. The buckling block 130 is buckled in the corresponding buckling groove 260 to fasten the fastening part 100 and the connector body 200 together. Lastly, the shielding shell 400 is mounted around the assembly of the fastening part 100, the connector body 200 and the base board 300 to form the electrical connector, wherein the fixing portion 420 is buckled in the fixing groove 120 to ensure the assembly firmly. The positioning tail 410 is positioned in the receiving groove 250 to ensue the front face of the connector body 200 flush with the end edge of the shielding shell 400, and the contact face of the connector body 200 substantially flush with the top edge of the positioning tail 410.

As described above, the electrical connector in this invention can be compatible with the USB 2.0 specification and the USB 3.0 specification, and meet the requirement of different signal transmission rates. Besides, the connector body 200 can be firmly positioned on the base board 300 to avoid warping because two ends thereof have adhesion with the base board 300 by means of the soldering of the soldering feet 234 and the soldering pads 303, and the soldering tails 211, 231 and the contact pads 301, 302. Moreover, the connector body 200 and the base board 300 can be firmly fastened in the shielding shell 400 by means of the fastening part 100. Furthermore, the positioning tail 410 is positioned in the receiving groove 250 so that can effectively ensue the front face of the connector body 200 flush with the end edge of the shielding shell 400, and the contact face of the connector body 200 substantially flush with the top edge of the positioning tail 410 so as to further avoid the mating end of the connector body 200 wrapping in use. So a good electrical connection can be achieved between the electrical connector and the mating connector.

The foregoing description of the present invention has been presented for the purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. An electrical connector, comprising:

a fastening part defining at least one fixing groove at a top thereof, at least one buckling block being protruded at a bottom of the fastening part;

a connector body assembled under the fastening part and equipped with a plurality of first terminals and second terminals of which each has a contact portion and a soldering tail, the contact portions being exposed in front of the fastening part and the soldering tails projecting behind the connector body, a front end of the connector body defining a guiding slope and at least one receiving groove adjacent to a distal end of the guiding slope, at least one side of a rear of the connector body defining a buckling groove buckling with the buckling block of the fastening part;

a base board positioned under the connector body and having a plurality of first contact pads and a plurality of second contact pads which are embedded and exposed on the base board and electrically soldered with the soldering tails of the first terminals and the second terminals; and a shielding shell enclosing the fastening part, the connector body and the base board therein, the shielding shell defining at least one fixing portion buckled with the fixing groove of the fastening part, at least one end edge of the shielding shell corresponding to the receiving groove of the connector body being bent inward to form a positioning tail positioned in the receiving groove to make a front face of the connector body flush with the end edge of the shielding shell, and make a top face of the connector body substantially flush with a top edge of the positioning tail.

2. The electrical connector as claimed in claim 1, wherein the base board is a COB (Chip on Board) or a PCB (Printed Circuit Board), the first contact pads and the second contact pads are apart arranged in a way of alternating with one another.

3. The electrical connector as claimed in claim 1, wherein the first contact pads and the first terminals have the same quantity as five and are cooperated to form a USB 3.0 connector, the second contact pads and the second terminals have the same quantity as four and are cooperated to form a USB 2.0 connector.

4. The electrical connector as claimed in claim 1, wherein the base board is further equipped with a USB controller, an indicator light and at least one flash memory, the USB connector and the flash memory are coupled with the first contact pads and the second contact pads, the indicator light is coupled with the USB controller.

5. The electrical connector as claimed in claim 4, wherein the fastening part is made of plastic materials and pervious to light, the fastening part further defines a receiving hole for receiving the indicator light of the base board therein.

6. The electrical connector as claimed in claim 5, wherein one end of the fastening part extends downward to form a blocking wall abutting behind the base board, the receiving hole is opened adjacent to an inner side of the blocking wall, the indicator light is located at a position of the base board corresponding to the receiving hole of the fastening part to be located in the receiving hole.

7. The electrical connector as claimed in claim 4, wherein the indicator light is a light-emitting diode.

8. The electrical connector as claimed in claim 1, wherein two outside edges of outmost two of the second terminals oppositely protrude sideward to form a pair of soldering feet near to the contact portions, the base board further defines two soldering pads corresponding to the soldering feet of the second terminals and soldered with the soldering feet respectively, two ends of the connector body have adhesion with the base board by the soldering of the soldering feet and the soldering pads, and the soldering tails and the contact pads.

9. The electrical connector as claimed in claim 1, wherein the fixing groove and the fixing portion have the same quantity as three.

10. The electrical connector as claimed in claim 1, wherein there are two buckling grooves oppositely opened in two side edges of the rear of the connector body, two sides of the bottom of the fastening part protrude downward to respectively form the buckling block.

11. The electrical connector as claimed in claim 1, wherein the contact portion of the second terminal defines a contact protrusion thereon to enhance an electrical contact thereof.

* * * * *